US006257245B1

(12) United States Patent
Woods et al.

(10) Patent No.: US 6,257,245 B1
(45) Date of Patent: Jul. 10, 2001

(54) HEADBAND FOR A HAIRPIECE

(76) Inventors: Linda Woods; Gerald Woods, both of 102 High St., Northport, MI (US) 49670

( * ) Notice: Subject to any disclaimer, the term of this patent is extended or adjusted under 35 U.S.C. 154(b) by 0 days.

(21) Appl. No.: 09/633,202

(22) Filed: Aug. 7, 2000

Related U.S. Application Data

(60) Provisional application No. 60/150,102, filed on Aug. 20, 1999.

(51) Int. Cl.[7] ..... A41G 5/00
(52) U.S. Cl. ..... 132/54
(58) Field of Search ..... 132/53, 54, 55, 132/56, 273, 274, 275, 201, 105; 2/174, 209.14

(56) References Cited

U.S. PATENT DOCUMENTS

| | | | | |
|---|---|---|---|---|
| 1,585 | * | 3/1840 | Bourguet | 132/54 |
| 415,104 | * | 11/1889 | Godefroy | 132/54 |
| 942,833 | * | 12/1909 | Latsch | 132/55 |
| 1,133,196 | * | 3/1915 | Teugler | 132/53 |
| 2,868,214 | * | 1/1959 | Levy | 132/273 |
| 3,858,590 | * | 1/1975 | Lowery | 132/275 |
| 4,966,173 | * | 10/1990 | Russell | 132/53 |
| 5,657,774 | * | 8/1997 | Niese | 132/105 |

* cited by examiner

*Primary Examiner*—Todd E. Manahan
*Assistant Examiner*—David C. Comstock
(74) *Attorney, Agent, or Firm*—Gifford, Krass, Groh, Sprinkle, Anderson & Citkowski, P.C.

(57) ABSTRACT

A headband is disclosed having a U-shaped band constructed of a flexible material, such as metal. The U-shaped band is dimensioned to fit over the head of a user so that the sides of the U-shaped band extend along the sides and behind the ears of the user's head and fictionally, but removably, secure the headband to the user's head. A V-shaped band has two ends that are secured to intermediate points of the U-shaped band so that the V-shaped band extends rearwardly from the U-shaped band and across the top of the head of the user. The hairpiece is then secured to both the U and V-shaped bands so that, with the headband positioned on the user's head, the hair covers areas of balding or partial balding on the user's head.

7 Claims, 1 Drawing Sheet

HEADBAND FOR A HAIRPIECE

This appln claim benefit of Provisional No. 60/150,102 filed Aug. 20, 1999.

SUMMARY OF THE PRESENT INVENTION

The present invention provides a headband for use with hair for women with partial baldness. In brief, the headband of the present invention comprises a U-shaped band constructed of a flexible material, such as spring steel. The U-shaped band is dimensioned to fit over the woman's head so that the sides of the U-shaped band extend along the sides of the user's head. In doing so, the U-shaped band frictionally, but removably, is secured to the woman's head.

The headband further comprises a V-shaped band having two free ends. The free ends of the V-shaped end are secured to spaced intermediate points along the U-shaped band so that, when the U-shaped band is positioned over the woman's head, the V-shaped extends rearwardly from the U-shaped band and over the top of the woman's head.

The hair is then secured to both the U-shaped band and the V-shaped band by any conventional means, such as by sewing. The headpiece may be made of either artificial, real or a blend of hair. Furthermore, the type and style of the hair can be customized or tailored to the particular woman so that the hairpiece covers only what is necessary to conceal the partial baldness of the user.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
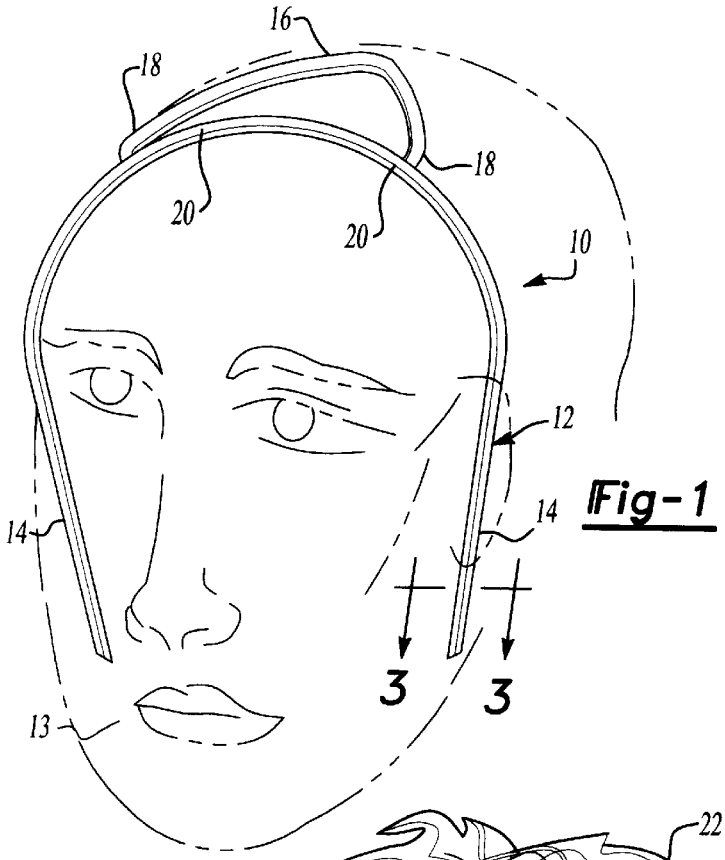
FIG. 1 is a perspective view illustrating a preferred embodiment of the present invention mounted to the head of a user, but without the attached hair.

With reference first to FIG. 1, a preferred embodiment of the headband 10 of the present invention is there shown. The headband 10 includes a generally U-shaped band 12 which is constructed of a flexible material. Furthermore, the U-shaped band 12 is dimensioned to fit over the head 13 of the user so that, in doing so, the sides 14 of the U-shaped band 12 extend along the sides of the head and behind the ears 13 of the user.

Figure 3:
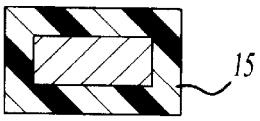
FIG. 3 is a sectional view taken substantially along line 3—3 in FIG. 1.

The band 12 can be constructed of any conventional flexible material, such as plastic, spring steel or stainless steel. As best shown in FIG. 3, if the band 12 is constructed of spring steel, the band 12 is preferably covered with a fabric covering 15.

With the band 12 positioned over the user's head 13, the band 12 is frictionally, but removably, secured to the user's head 13. Furthermore, the resiliency of the band 12 is such that the band 12 does not cause undue pressure on the user's head 13, but rather is merely sufficient to retain the band 12 to the user's head 13.

The headband 10 further comprises a generally V-shaped band 16 having two spaced apart free ends 18. These free ends 18 are secured in any conventional fashion to spaced intermediate points 20 of the U-shaped band 12. Consequently, with the band 12 secured to the user's head 13 so that the sides 14 of the band 12 extend along the sides and behind the ears of the user's head 13, the V-shaped band 16 extends rearwardly from the U-shaped band 12 and overlies the top of the user's head. Preferably, the V-shaped band 16 is positioned closely adjacent or in contact with the user's head 13. For that reason, the V-shaped band 16 is preferably slightly arcuately formed in order to conform to the natural curve of the user's head 13.

Like the band 12, the band 16 is constructed of any conventional flexible material, such as plastic, spring metal or stainless steel. If constructed of spring metal, the V-shaped band 16 is preferably covered with a fabric covering.

Figure 2:
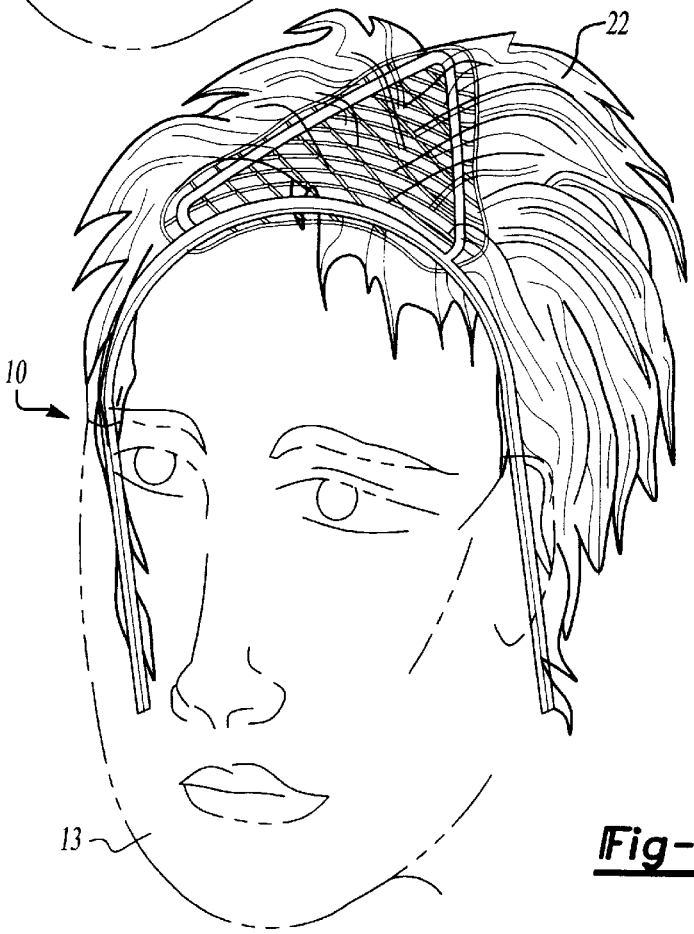
FIG. 2 is a view similar to FIG. 1 but illustrating the headband with attached hair.

With reference now to FIG. 2, the hair 22 is secured to both the V-shaped band 16 as well as the U-shaped band 12. This hair 22 may be constructed of either artificial, real or a blend of hair and is secured to the bands 16 and 12 in any conventional fashion, such as by sewing.

In practice, the hair 22 is applied to overlie the partial baldness of the user's head. Consequently, the precise shape of the hairpiece 22 will vary depending upon the baldness pattern of the user.

After the hair 22 is secured to the bands 12 and 16, the headband 12 is positioned over the head and behind the ears of the user. In doing so, the hairpiece 22 covers the partial baldness of the wearer and provides the appearance of a full head of hair.

A primary advantage of the present invention is that it is both inexpensive and simple to both put on and remove. Furthermore, since the hair 22 covers the areas of partial baldness for the individual wearer, the previously known problems associated with full wigs is completely avoided.

Having described my invention, however, many modifications thereto will become apparent to those skilled in the art to which it pertains without deviation from the spirit of the invention as defined by the scope of the appended claims.

We claim:

1. A headband comprising:

a U-shaped band constructed of a flexible material, said U-shaped band dimensioned to fit over the head of a user so that sides of said U-shaped band extend downwardly along the sides of the user's head, a V-shaped band having two ends, said ends of said V-shaped band being secured to intermediate points of said U-shaped band so that said V-shaped band extends rearwardly from said U-shaped band and across the top of the head of a user, said V-shaped band being concavely shaped so as to flatly abut against the top of the head of the user, said V-shaped band and said U-shaped band forming a generally triangular opening aligned with the top of the head of the user, and a hairpiece secured to at least one of said bands so that said hairpiece fills said triangular opening and overlies said V-shaped band and at least a portion of said U-shaped band.

2. The invention as defined in claim 1 wherein said U-shaped band is constructed of metal.

3. The invention as defined in claim 1 wherein said V-shaped band is constructed of metal.

4. The invention as defined in claim 1 and comprising a fabric covering disposed around said U-shaped band.

5. The invention as defined in claim 1 and comprising a fabric covering disposed around said V-shaped band.

6. The invention as defined in claim 1 wherein said V-shaped band is made of plastic.

7. The invention as defined in claim 1 wherein said U-shaped band is constructed of plastic.

* * * * *